United States Patent [19]

Steinort

[11] Patent Number: 4,951,458

[45] Date of Patent: Aug. 28, 1990

[54] TUNNEL-TYPE WASHING MACHINE WITH ECCENTRIC AUGER AXIS

[75] Inventor: Hans Steinort, Hildesheim, Fed. Rep. of Germany

[73] Assignee: Senkingwerk GmbH, Hildesheim, Fed. Rep. of Germany

[21] Appl. No.: 420,057

[22] Filed: Oct. 11, 1989

[30] Foreign Application Priority Data

Oct. 15, 1988 [DE] Fed. Rep. of Germany ..... 3835278

[51] Int. Cl.[5] ..... D06F 31/00

[52] U.S. Cl. ..... 68/27; 68/145

[58] Field of Search ..... 68/27, 58, 143, 145; 134/65, 132; 51/164.1; 198/658

[56] References Cited

U.S. PATENT DOCUMENTS

| | | | |
|---|---|---|---|
| 3,878,699 | 4/1975 | Steinort | 68/145 |
| 3,969,913 | 7/1976 | Schaper | 134/65 X |
| 4,829,792 | 5/1989 | Keith | 68/58 X |

FOREIGN PATENT DOCUMENTS

| | | | |
|---|---|---|---|
| 2053286 | 2/1981 | United Kingdom | 68/145 |

*Primary Examiner*—Philip R. Coe

*Attorney, Agent, or Firm*—Herbert Dubno; Andrew Wilford

[57] ABSTRACT

A washing machine has a generally cylindrical drum extending along and centered on a horizontal drum axis and a helicoidal auger-like wall centered on an auger axis offset radially from and extending substantially parallel to the drum axis. At least one longitudinally extending rib on an inner surface of the drum is relatively closely spaced to a plane including the drum and auger axes and the rest of the drum inner surface is substantially free of such ribs. This construction allows the machine to operate with substantially higher capacity. During washing oscillation the ribs are lowermost and a much larger load can be accommodated since the drum axis lies between tbe auger axis and the ribs. Normally two such ribs are provided on the drum inner surface closely flanking the plane.

6 Claims, 2 Drawing Sheets

TUNNEL-TYPE WASHING MACHINE WITH ECCENTRIC AUGER AXIS

FIELD OF THE INVENTION

The present invention relates to a washing machine. More particularly this invention concerns a tunnel-type batch-washing machine.

BACKGROUND OF THE INVENTION

As described in German patent document 2,927,873 filed 11 July 1979 by H. Steinort and E. Hortmann, a standard tunnel-type batch-washing machine has a normally cylindrical drum centered on and rotatable about a horizontal axis and provided internally with a helicoidal wall or rib that is also centered on the drum axis. The wall defines below the axis a succession of separated compartments each adapted to hold a respective batch of wash along with an appropriate treatment liquid, normally either soapy water or rinse water although the invention could be used with other batch-type liquid-treatment machines. For washing action the drum is oscillated about its axis through substantially less than 360° so that each batch just moves angularly back and forth and also limited longitudinally in its compartment with its treatment liquid. Periodically the drum is rotated through more than a full revolution so that each batch is stepped or indexed downstream into the next compartment where the treatment liquid might be changed and the next stage of the washing operation takes place. As described in German patent document 2,944,857 it is also known to provide the drum internally with longitudinally extending ribs to enhance the mechanical washing action.

The main problem with such machines is that their capacity is relatively limited, that is the batch size is quite small. The only way to increase this capacity is with a substantial increase in radius. Since, however, the batches use only the bottom half or third of the drum, it is necessary to increase the drum size enormously for only a modest increase in batch size.

OBJECTS OF THE INVENTION

It is therefore an object of the present invention to provide an improved tunnel-type washing machine.

Another object is the provision of such an improved tunnel-type washing machine which overcomes the above-given disadvantages, that is which is of modest size but which nonetheless is of large capacity.

SUMMARY OF THE INVENTION

A washing machine according to this invention has a generally cylindrical drum extending along and centered on a horizontal drum axis and a helicoidal auger-like wall centered on an auger axis offset radially from and extending substantially parallel to the drum axis. At least one longitudinally extending rib on an inner surface of the drum is relatively closely spaced to a plane including the drum and auger axes and the rest of the drum inner surface is substantially free of such ribs.

This construction allows the machine to operate with substantially higher capacity. During washing oscillation the ribs are lowermost and a much larger load can be accommodated since in accordance with this invention the drum axis lies between the auger axis and the ribs. Normally two such ribs are provided on the drum inner surface closely flanking the plane.

Furthermore according to this invention the wall is of substantially constant pitch relative to the auger axis. This makes it easy to construct the wall and also ensures that the axial step between adjacent compartment will be relatively large so that relatively large loads can be accommodated.

DESCRIPTION OF THE DRAWING

The above and other objects, features, and advantages will become more readily apparent from the following, reference being made to the accompanying drawing in which.

SPECIFIC DESCRIPTION

Figure 1A:
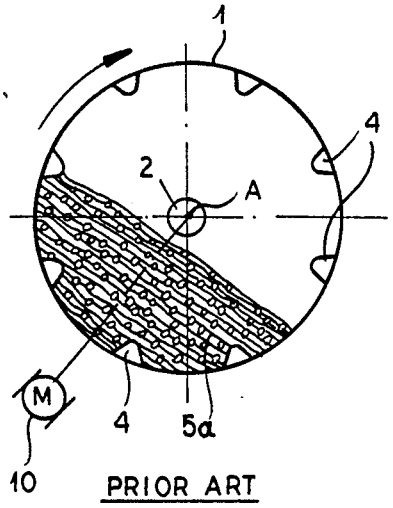
FIGS. 1*a* and 1*b* are cross sections through a prior-art washing machine.
Figure 1B:
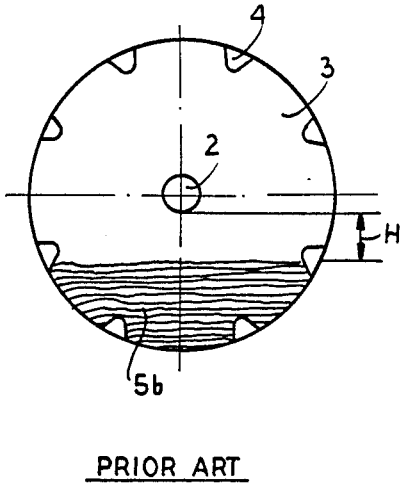

As seen in FIGS. 1*a* and 1*b* a prior-art washing machine has a drum 1 centered on an axis A along which extends the central hole 2 of an auger-like helicoidal wall 3. The inner surface of the drum 1 is provided with longitudinally extending ribs 4 angularly equispaced about the axis A. As seen in FIG. 1*a* a motor 10 can oscillate the drum 1, wall 3, and ribs 4 about the axis A so that a batch of wash in liquid occupies a volume 5*a*. When the batch is quiescent it occupies a smaller volume 5*b* (FIG. 1*b*).

The holding capacity of the drum 1 is limited in that none of the wash should be able to reach the central hole 2 of the wall 3 or a shaft frequently at this location. When agitated as seen in FIG. 1*a* the upper level of the load is fairly close to this hole 2, but when the load is not agitated but is being stepped downstream by a full revolution of the drum 1 it is spaced a fairly large distance H therebelow.

Figure 2A:
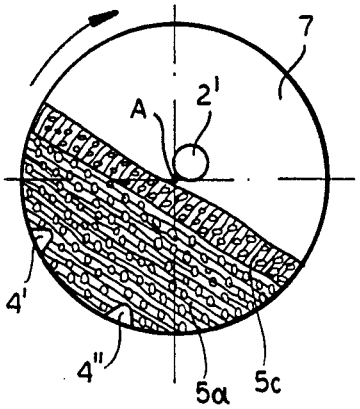
FIGS. 2*a* and 2*b* are cross sections like FIGS. 1*a* and 1*b* through the machine according to this invention.
Figure 2B:
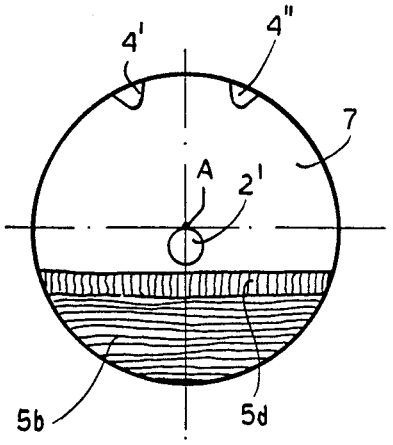

FIGS. 2*a* and 2*b* show a system according to this invention where a wall 7 is used whose central hole 2' is centered on an axis 9 (FIG. 3) offset roughly half the distance H from the axis A. In addition in this arrangement the drum 1 only has two ribs 4' and 4'' which are spaced apart relative to the axis A only by an acute angle of about 38° and which equidistantly flank a plane that includes the axis A and that bisects the hole 2.

Thus with this system there is as shown in FIG. 2*a* during agitation sufficient room for the volume 5*a* plus a volume 5*c*, while when the load is quiescent, that is not filled with bubbles, it only has a volume 5*b* +5*d* which still lies below the hole 2. It is in this FIG. 2*b* position that the load is transferred from one compartment to the next downstream one.

Figure 3:
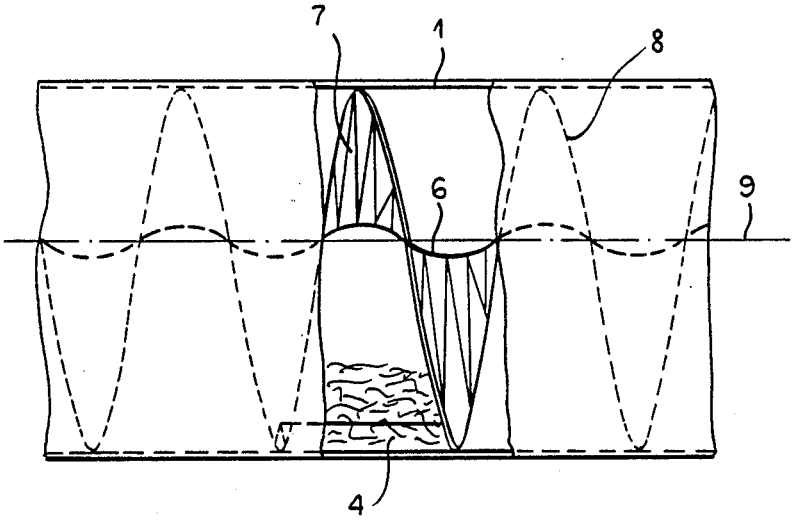
FIG. 3 is a longitudinal section through the machine of this invention.

According to this invention the wall 7 is of constant pitch relative to the axis 9. This has the advantage that the wall 7 can be made on a standard tool like the wall of a standard concentric type of washing machine such as shown in FIGS. 1*a* and 1*b*, only trimmed differently. As seen in FIG. 3 this means that during washing the axial or longitudinal movement of the load is relatively small compared to such movement during the transport phase. The inner edge of the wall 7 therefore follows a perfectly regular helix while the outer edge 8 does not. The result is that during washing the axial space between adjacent turns of the wall 7 is relatively great for a big washing compartment, and the full revolution used to step the loads downstream can account for a substantial axial shift.

I claim:

1. A washing machine comprising:

a generally cylindrical drum extending along and centered on a horizontal drum axis;

a helicoidal auger-like wall centered on an auger axis offset radially from and extending substantially parallel to the drum axis; and at least two longitudinally extending ribs on an inner surface of the drum relatively closely flanking a plane including the drum and auger axes, the rest of the drum inner surface being substantially free of such ribs.

2. The machine defined in claim 1 wherein the wall is of substantially constant pitch relative to the auger axis.

3. The machine defined in claim 1 wherein the drum axis lies between the auger axis and the ribs.

4. A washing machine comprising:

a generally cylindrical drum extending along and centered on a horizontal drum axis;

a helicoidal auger-like wall centered on an auger axis offset radially from and extending substantially parallel to the drum axis; and at least one longitudinally extending rib on an inner surface of the drum relatively closely spaced to a plane including the drum and auger axes, the rest of the drum inner surface being substantially free of such ribs, the drum axis lying between the auger axis and the ribs.

5. The machine defined in claim 4 wherein two such ribs are provided on the drum inner surface closely flanking the plane.

6. The machine defined in claim 4 wherein the wall is of substantially constant pitch relative to the auger axis.

* * * * *